US012533547B2

(12) United States Patent
Liu et al.

(10) Patent No.: US 12,533,547 B2
(45) Date of Patent: Jan. 27, 2026

(54) STATIONARY BIKE CAPABLE OF ADJUSTING RESISTANCE AND SLOPE SIMULTANEOUSLY

(71) Applicant: Dyaco International Inc., Taipei (TW)

(72) Inventors: Shih-Wei Liu, Taipei (TW); Wei-Hsiang Lin, Changhua County (TW)

(73) Assignee: Dyaco International Inc., Taipei (TW)

( * ) Notice: Subject to any disclaimer, the term of this patent is extended or adjusted under 35 U.S.C. 154(b) by 67 days.

(21) Appl. No.: 18/771,447

(22) Filed: Jul. 12, 2024

(65) Prior Publication Data

US 2025/0381438 A1 Dec. 18, 2025

(30) Foreign Application Priority Data

Jun. 18, 2024 (TW) ..... 113122555

(51) Int. Cl.

| | |
|---|---|
| ***A63B 22/00*** | (2006.01) |
| ***A63B 21/00*** | (2006.01) |
| ***A63B 21/015*** | (2006.01) |
| ***A63B 21/22*** | (2006.01) |
| ***A63B 22/06*** | (2006.01) |
| ***A63B 71/00*** | (2006.01) |

(52) U.S. Cl.

CPC ..... *A63B 22/0046* (2013.01); *A63B 21/015* (2013.01); *A63B 21/225* (2013.01); *A63B 21/4035* (2015.10); *A63B 22/0605* (2013.01); *A63B 2071/0081* (2013.01); *A63B 2225/093* (2013.01)

(58) Field of Classification Search

CPC . A63B 22/0046; A63B 21/015; A63B 21/225; A63B 21/4035; A63B 22/0605; A63B 2071/0081; A63B 2225/093

See application file for complete search history.

(56) References Cited

U.S. PATENT DOCUMENTS

| | | | | |
|---|---|---|---|---|
| 6,049,150 | A * | 4/2000 | Chudleigh, Jr. | F16F 15/30 74/572.11 |
| 9,861,872 | B1 * | 1/2018 | Hsiung | A63B 22/0046 |
| 10,996,119 | B1 * | 5/2021 | Lin | A63B 21/4034 |
| 11,383,127 | B1 * | 7/2022 | Houchin-Miller | A63B 22/0605 |
| 2017/0072254 | A1 * | 3/2017 | Ryu | A63G 31/16 |
| 2019/0381351 | A1 * | 12/2019 | Irving | A63B 21/225 |
| 2020/0061409 | A1 * | 2/2020 | Lin | A63B 21/225 |
| 2020/0069997 | A1 * | 3/2020 | Lin | A63B 22/0605 |

(Continued)

*Primary Examiner* — Sundhara M Ganesan

(74) *Attorney, Agent, or Firm* — Donald E. Stout; Stout, Uxa & Buyan, LLP

(57) ABSTRACT

A stationary bike includes a first lifting arm, a second lifting arm, a frame, a resistance device, a reluctance mechanism, a linkage mechanism, and a linear mechanism. The first and second lifting arms respectively are turnable with their first ends as fulcrums and their second ends are pivotally connected to each other at a pivot point. The frame may be connected to the first lifting arm. The linkage mechanism is pivotally connected to the reluctance mechanism and may be connected to the second lifting arm through a steel cable. The linear mechanism is connected between the frame and the second lifting arm, and its length can be adjusted to change the angle between the first/second lifting arm and the ground. At the same time, the resistance applied by the reluctance mechanism to the resistance device is varied.

11 Claims, 5 Drawing Sheets

(56) References Cited

U.S. PATENT DOCUMENTS

| | | | | |
|---|---|---|---|---|
| 2020/0122011 | A1* | 4/2020 | Papadopoulos | A63B 69/16 |
| 2020/0215381 | A1* | 7/2020 | Bass | A63B 71/023 |
| 2021/0052937 | A1* | 2/2021 | Chen | A63B 21/0428 |
| 2021/0060380 | A1* | 3/2021 | Hawkins, III | A63B 21/225 |
| 2021/0146192 | A1* | 5/2021 | Smits | A63B 21/0087 |
| 2021/0162291 | A1* | 6/2021 | Lee | A63B 24/0062 |
| 2021/0197015 | A1* | 7/2021 | Anderson | A63B 21/012 |
| 2021/0228939 | A1* | 7/2021 | McAllister | A63B 22/0605 |
| 2021/0252335 | A1* | 8/2021 | Brewer | A63B 22/0605 |
| 2021/0275862 | A1* | 9/2021 | Kim | A63B 22/0605 |
| 2021/0291012 | A1* | 9/2021 | Fung | A63F 13/65 |
| 2021/0362000 | A1* | 11/2021 | Iverson | A63F 13/245 |
| 2022/0134179 | A1* | 5/2022 | Taylor | A63B 22/0605 482/4 |
| 2022/0176197 | A1* | 6/2022 | Pacheco Hernandez | G09B 9/00 |
| 2022/0249905 | A1* | 8/2022 | Bass | A63B 22/0023 |
| 2022/0387870 | A1* | 12/2022 | Yu | A63B 22/0605 |
| 2023/0145780 | A1* | 5/2023 | Zapirain Elosegui | A63B 71/023 482/57 |
| 2023/0173335 | A1* | 6/2023 | Simmonds | A63B 71/0622 482/4 |
| 2023/0405397 | A1* | 12/2023 | Lucas | A63B 22/0046 |
| 2024/0009510 | A1* | 1/2024 | Kogler | A63B 22/0605 |
| 2024/0131391 | A1* | 4/2024 | Hammer | A63B 22/0605 |
| 2024/0189659 | A1* | 6/2024 | Wang | A63B 22/0605 |
| 2025/0050187 | A1* | 2/2025 | Chen | A63B 69/16 |
| 2025/0135272 | A1* | 5/2025 | Wilfert | A63B 22/0605 |
| 2025/0177811 | A1* | 6/2025 | Caccia | A63B 71/0622 |
| 2025/0222332 | A1* | 7/2025 | Díaz Martinez | A63B 22/0046 |
| 2025/0249334 | A1* | 8/2025 | Abbas | A63B 21/00069 |

* cited by examiner

STATIONARY BIKE CAPABLE OF ADJUSTING RESISTANCE AND SLOPE SIMULTANEOUSLY

CROSS-REFERENCE TO RELATED APPLICATIONS

The entire contents of Taiwan Patent Application No. 113122555, filed on Jun. 18, 2024, from which this application claims priority, are expressly incorporated herein by reference.

BACKGROUND OF THE INVENTION

1. Field of the Invention

The present invention generally relates to an indoor fitness machine, and particularly relates a stationary bike that can simultaneously adjust its slope and resistance.

2. Description of Related Art

Indoor exercise is great alternative to bad weather, and it provides a variety of benefits from being physically active on commercial fitness equipment, such as strengthening muscles, improving mood, burning calories, and enhancing physical fitness. Among the fitness equipment, stationary bikes are more helpful to improve cardiopulmonary function and strengthen core muscles.

Most of the commercial stationary bikes have a resistance adjustment function but cannot change the incline. Some bikes feature adjustable incline. For example, U.S. Pat. No. 10,561,877B2 (TW637770B) discloses an exercise machine that includes a frame, which includes a base portion, an upright portion, and a pivot joint. The upright portion couples to the base portion at a single pivot. The pivot joint connects the upright portion to the base portion at the single pivot. The pivot joint includes a drop-in axle and a drop-in receptacle. The drop-in axle connects to the upright portion. The drop-in receptacle connects to the base portion. The exercise machine further includes a tilt actuator that connects the base portion of the frame to the upright portion of the frame and determines an angle that the upright portion forms with respect to the base portion.

In addition, U.S. Pat. No. 9,278,249B2 discloses an exercise cycle including a base support, an upright support structure, a seat mounted on the upright support structure, a handlebar assembly mounted on the upright support structure, a pedal assembly connected to the upright support structure, and one or more vibration assemblies. The one or more vibration assemblies are controlled by a controller to adjust vibrations to cause at least one of the seat, the handlebar assembly, and the pedal assembly to simulate an outdoor trail. And the one or more vibration assemblies change intensity or frequency of the vibrations based on one of the tilted positions of the upright support structure. The exercise cycle further includes an extension mechanism connected between the base support and the upright support structure, wherein the extension mechanism selectively moves the upright support structure between the plurality of tilted positions.

Conventional stationary bikes all include a stable base structure that is pivotally connected to an upright structure above it. The angle between the upright structure and the base structure is changed through a tilt actuator or an extension mechanism between them, thereby changing the slope of the stationary bike. While changing the slope, the resistance of the flywheel remains constant, and resistance is usually adjusted through additional operations and mechanisms.

SUMMARY OF THE INVENTION

This summary is provided to introduce a selection of concepts in a simplified form that are further described below in the detailed description. This summary, and the foregoing background, is not intended to identify key aspects or essential aspects of the claimed subject matter. Moreover, this summary is not intended for use as an aid in determining the scope of the claimed subject matter.

In one aspect, a stationary bike is provided with a first lifting arm, a second lifting arm, a frame, a reluctance mechanism, a linkage mechanism, a first cable, and a linear mechanism. The first lifting arm comprises a first end in contact with a ground and a second end suspended above the ground, wherein the first lifting arm is turnable with its first end as a fulcrum. The second lifting arm comprises a first end in contact with the ground and a second end suspended above the ground, wherein the second lifting arm is turnable with its first end as a fulcrum, and the second end of the first lifting arm and the second end of the second lifting arm are pivotally connected at a pivot. The frame is connected to the first lifting arm. The resistance device is disposed on the frame and comprises an axis and a flywheel. The reluctance mechanism, comprising a plurality of magnets, is adjacent to the flywheel and pivotally connected to the frame. The linkage mechanism comprises a first linkage seat that is pivotally connected to the reluctance mechanism. The first cable includes two ends respectively connected to the first linkage seat and the second lifting arm or the first lifting arm. The linear mechanism is connected between the frame and the second lifting arm, wherein a length of the linear mechanism is adjusted to change an angle between the first lifting arm and the ground and an angle between the second lifting arm and the ground, and at the same time the first cable drives the first linkage seat, causing the reluctance mechanism to pivot and hence to approach or move away from the flywheel thereby changing a resistance applied to the flywheel.

In some embodiments, the reluctance mechanism comprises two side plates, the first linkage seat is U-shaped and comprises two sides with each comprising a first slot, and an outer surface of each of the two side plates has a first flange disposed in one corresponding first slot.

In some embodiments, the linkage mechanism further comprises a first spring and a spring seat, and wherein the spring seat is fixed to the first lifting arm or the frame or disposed between the two, and the first spring is disposed between the spring seat and the first linkage seat.

In some embodiments, the stationary bike further comprises an emergency brake lever and a second cable, wherein the linkage mechanism further comprises a second linkage seat pivotally connected to the reluctance mechanism, and two ends of the second cable are respectively connected to the emergency brake lever and the second linkage seat.

In some embodiments, the second linkage seat is U-shaped and comprises two sides with each comprising a second slot, and an outer surface of each of the two side plates has a second flange disposed in one corresponding second slot.

In some embodiments, the linkage mechanism further comprises a second spring and a spring seat, and wherein the spring seat is fixed to the first lifting arm or the frame or disposed between the two, and the second spring is disposed between the spring seat and the second linkage seat.

In some embodiments, the frame comprises a handle support and a seat support.

In some embodiments, the linear mechanism is connected between the handle support and the second lifting arm.

In some embodiments, the linear mechanism is connected between the seat support and the first lifting arm.

In some embodiments, the linear mechanism comprises a motor, a sleeve, and a screw, and wherein the sleeve comprises an internal thread to engage the screw, and the motor is used to drive the screw to rotate, so that the sleeve is moved along the screw toward or away from the motor, thereby changing the length of the linear mechanism.

In some embodiments, when the linear mechanism adjusts its length to change the angle between the first lifting arm and the ground and the angle between the second lifting arm and the ground, both an angle between the handle support and the ground and an angle between the seat support and the ground change accordingly.

The provided stationary bikes replace the traditional "base" with a first lifting arm and a second lifting arm. This design allows the stationary bikes to have a larger adjustable slope range. In addition, when the linear mechanism changes its length, the resistance applied to the flywheel also increases or decreases simultaneously for a realistic riding experience.

BRIEF DESCRIPTION OF THE DRAWINGS

Non-limiting and non-exhaustive embodiments of the disclosed technology, including the preferred embodiment, are described with reference to the following figures, wherein like reference numerals refer to like parts throughout the various views unless otherwise specified.

DETAILED DESCRIPTION OF THE PREFERRED EMBODIMENT

Embodiments are described more fully below with reference to the accompanying Figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
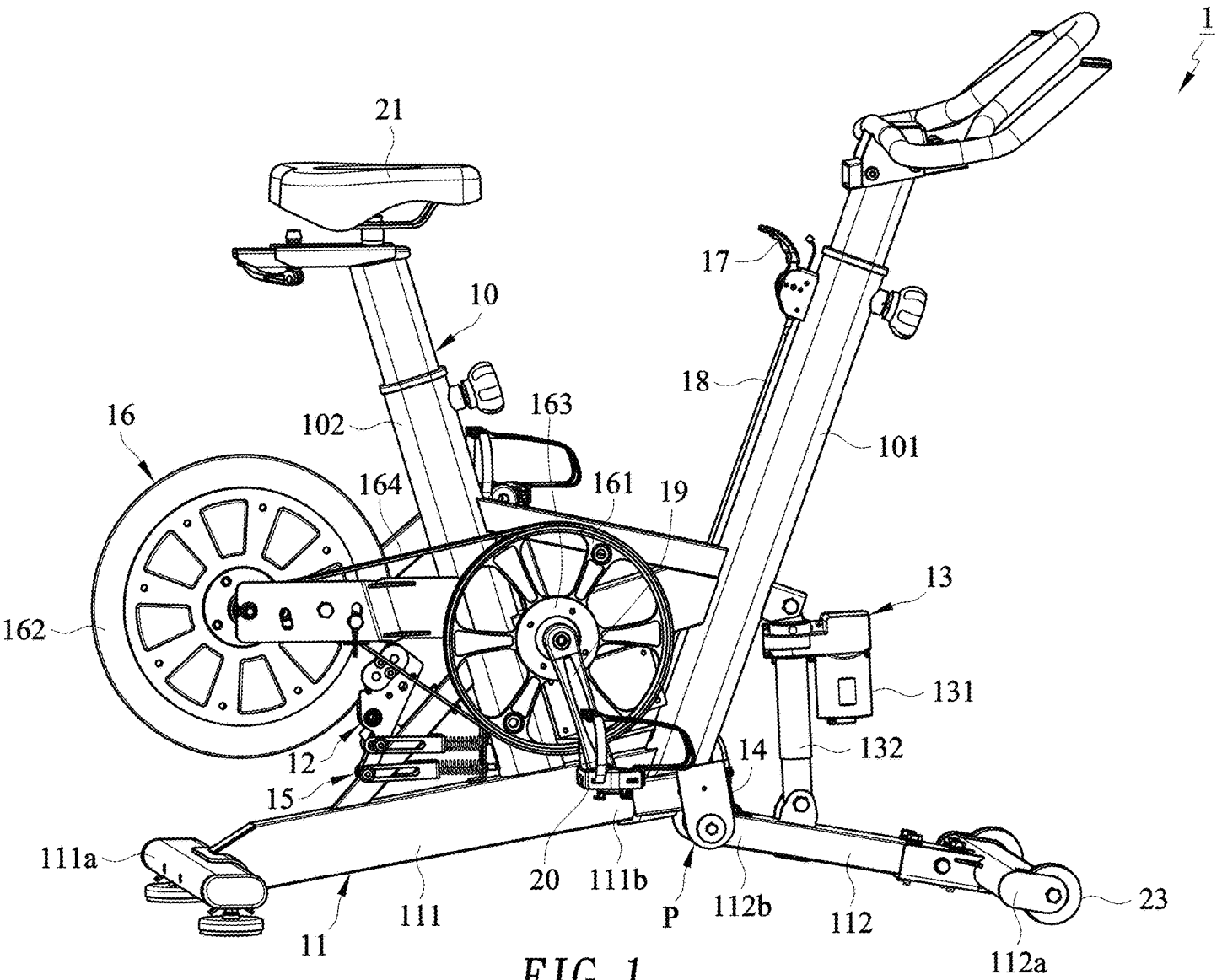
FIG. 1 is a perspective view showing a stationary bike in accordance with an embodiment of the present invention.
Figure 2:
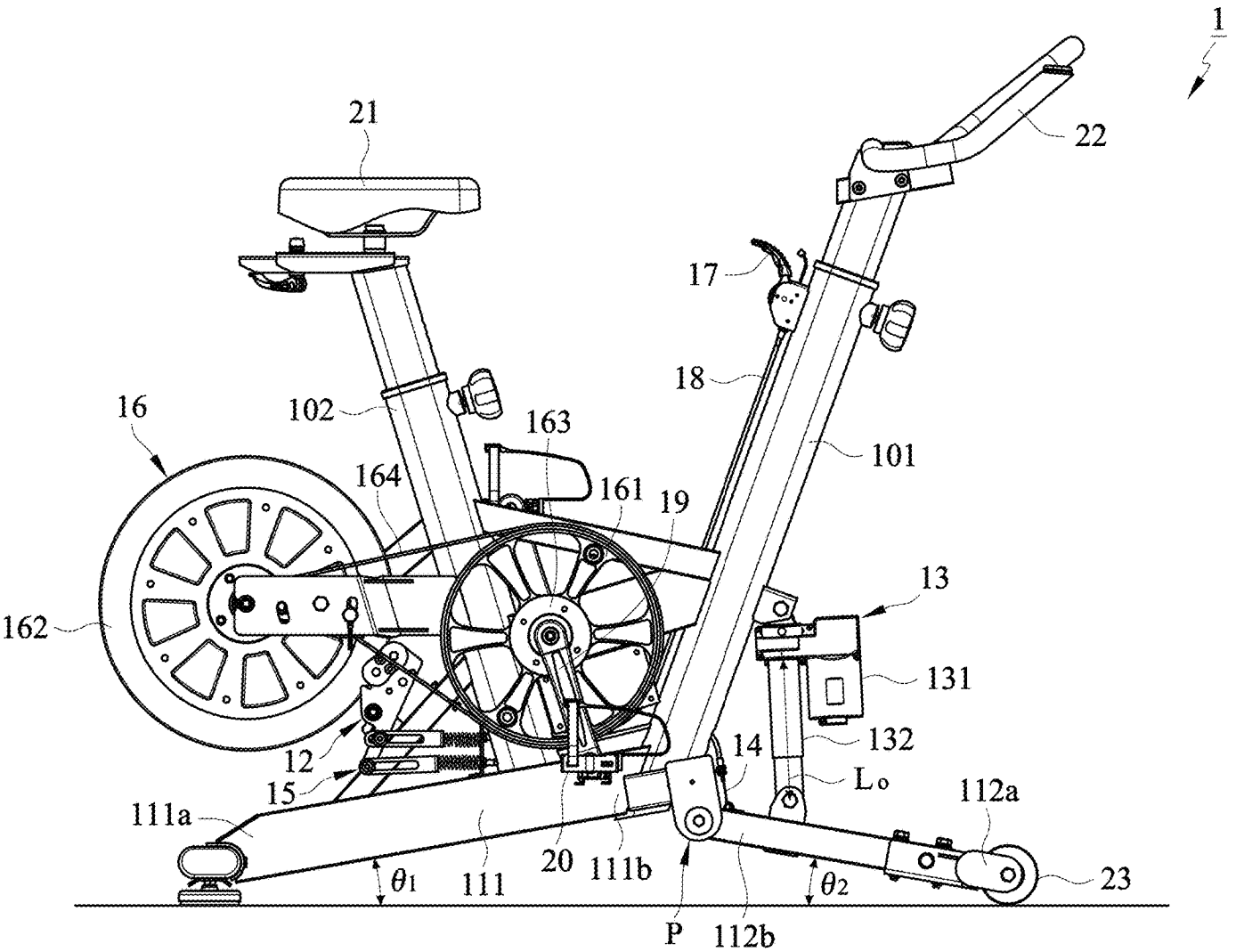
FIG. 2 is a side view showing that the stationary bike of FIG. 1 is operated on a flat road (initial resistance).
Figure 3:
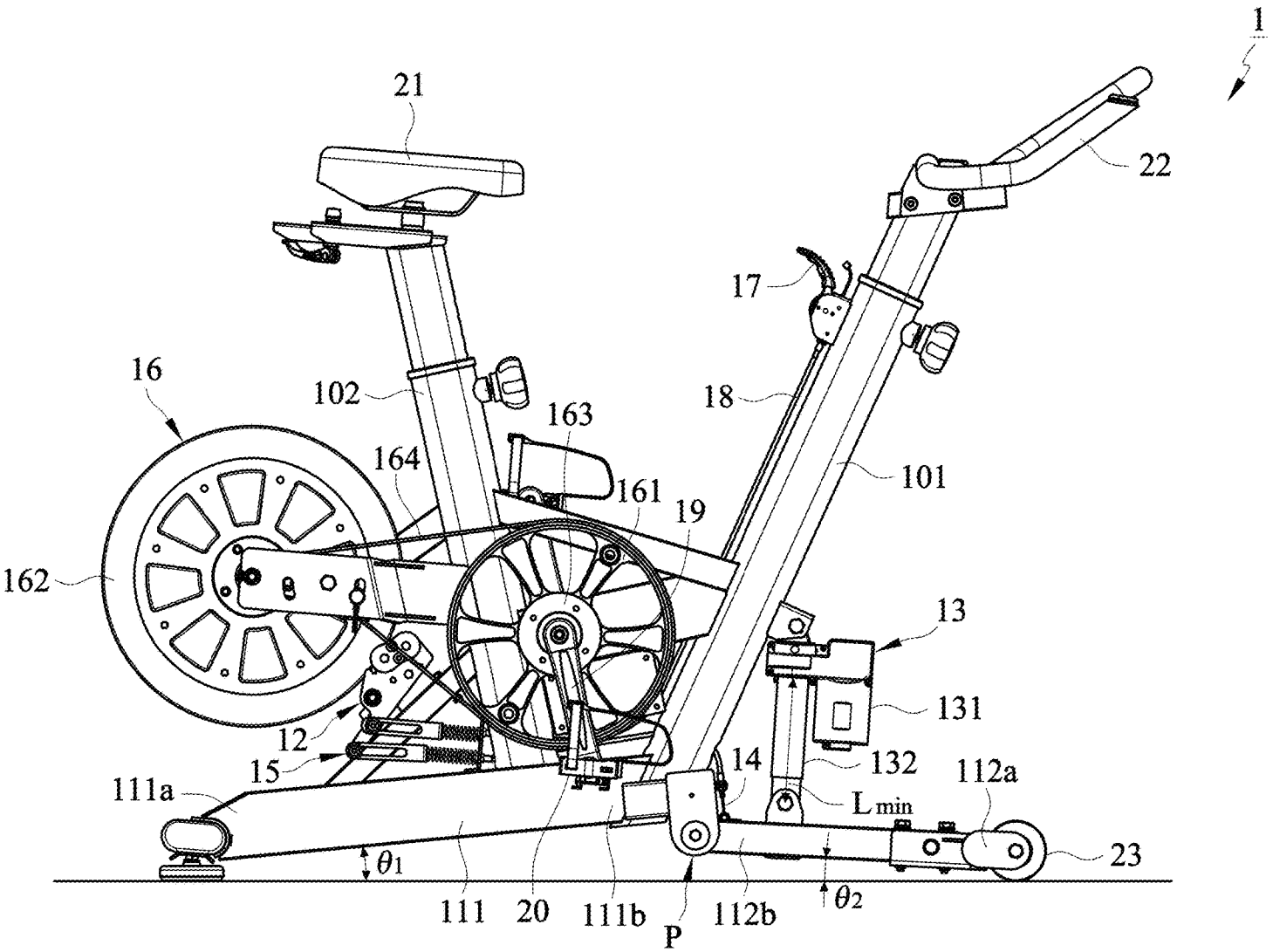
FIG. 3 is a side view showing that the stationary bike of FIG. 1 is operated on a downhill road (minimum resistance).
Figure 4:
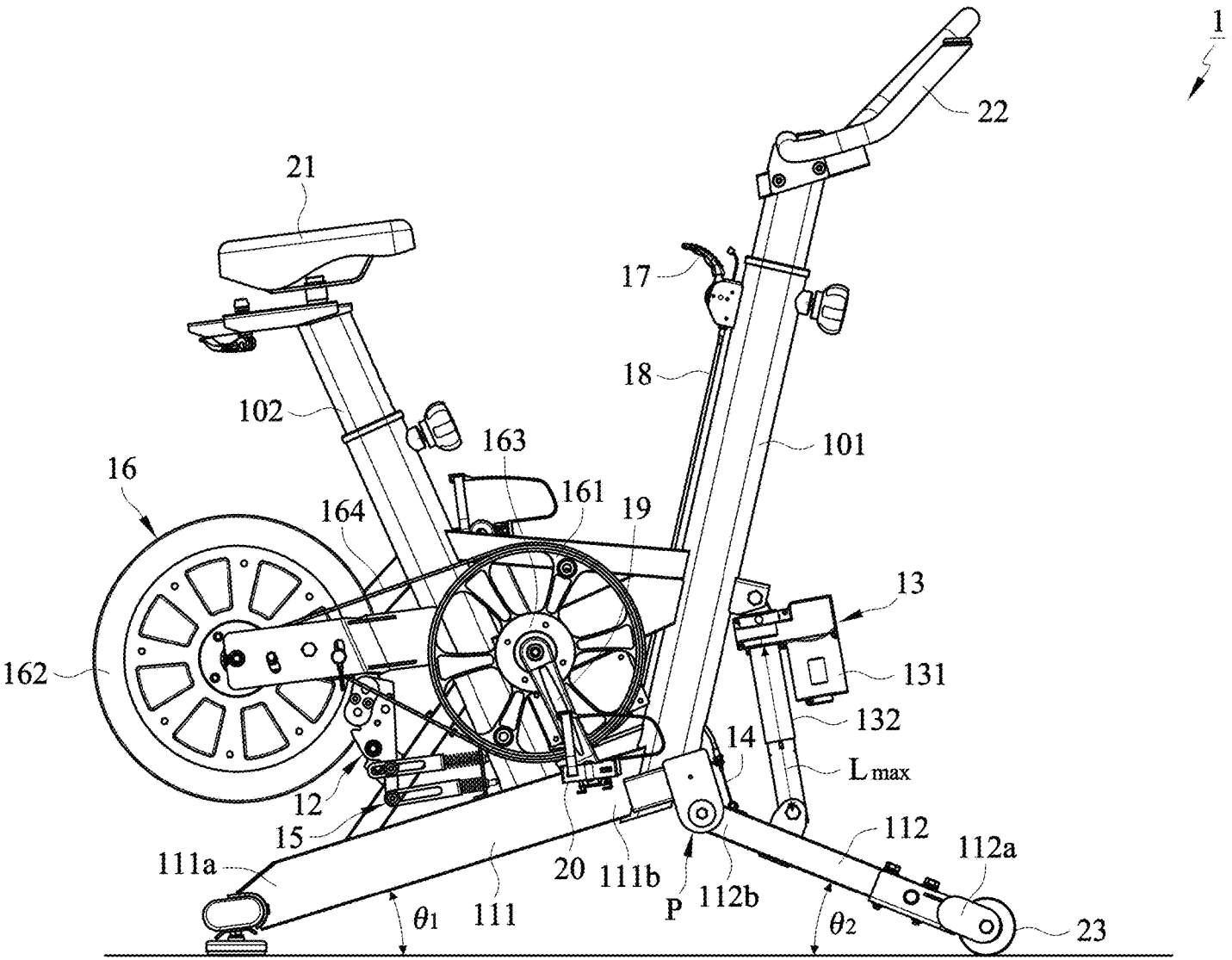
FIG. 4 is a side view showing that the stationary bike of FIG. 1 is operated on an uphill road (maximum resistance).

FIG. 1 is a perspective view showing a stationary bike 1 in accordance with an embodiment of the present invention. The stationary bike 1 features that its slope and resistance can be adjusted simultaneously. FIGS. 2-4 are respectively side views showing the stationary bike being operated on a flat road (initial resistance), a downhill road (minimum resistance), and an uphill road (maximum resistance). Referring to FIGS. 1, 2, 3, and 4, the stationary bike 1 generally includes a frame 10, a lifting mechanism 11, a reluctance mechanism 12, a linear mechanism 13, a first cable 14, a linkage mechanism 15, and a resistance device 16. In addition, the stationary bike 1 may optionally include an emergency brake lever 17 and a second cable 18.

Referring to FIGS. 1, 2, 3, and 4, the lifting mechanism 11 includes a first lifting arm 111 and a second lifting arm 112. The first lifting arm 111 includes a first end 111*a* and a second end 111*a*, and the second lifting arm 112 includes a first end 112*a* and a second end 112*b*. The first lifting arm 111 is turnable with its first end 111*a* as a fulcrum, resulting in a first included angle θ1 between the first lifting arm 111 and the ground. The second lifting arm 112 is turnable with its first end 112*a* as a fulcrum, resulting in a second included angle θ2 between the second lifting arm 112 and the ground. The second end 111*b* of the first lifting arm 111 and the second end 112*b* of the second lifting arm 112 are pivotally connected at the pivot P.

Referring to FIGS. 1, 2, 3, and 4, the term "frame" refers to one or more support mechanisms above the first lifting arm 111. In the exemplary embodiment, the frame 10 includes a handle support 101 and a seat support 102 on the first lifting arm 111. In the exemplary embodiment, the handle support 101 and the seat support 102 are fixed with the first lifting arm 111. Therefore, as the first included angle θ1 changes, the angles of the handle support 101 and the seat support 102 relative to the ground will change as well.

Referring to FIGS. 1, 2, 3, and 4, the linear mechanism 13 is connected between the frame 10 and the second lifting arm 112. The linear mechanism 13 can be connected to any of the one or more supporting mechanisms of the frame 10. In the exemplary embodiment, the linear mechanism 13 is connected between the handle support 101 of the frame 10 and the second lifting arm 112. The linear mechanism 13 is capable of adjusting its length. When the linear mechanism 13 changes its length, the first lifting arm 11 is turned with its first end 111*a* as a fulcrum, and the second lifting arm 112 is turned with its first end 112*a* as a fulcrum, resulting in a change of the first included angle θ1 and a change of the second included angle θ2.

Referring to FIGS. 1, 2, 3, and 4, in the exemplary embodiment, the linear mechanism 13 includes a motor 131, a sleeve 132, and a screw (hidden in the sleeve 132). The sleeve 132 includes an internal thread to engage the screw, and the motor 131 is used to drive the screw rotating. As the motor 131 drives the screw to rotate, the sleeve 132 moves along the screw in a direction toward or away from the motor 131, thereby changing the length of the linear mechanism 13. In other embodiments of the present invention, the linear mechanism 13 may be other linearly extendable devices, such as, but is not limited to, a linear actuator.

Referring to FIGS. 1, 2, 3, and 4, in the exemplary embodiment, the stationary bike 1 include a resistance device 16. As a non-limiting example, the resistance device 16 may include a pulley 161 and a flywheel (inertia wheel) 162. The pulley 161 includes an axis 163 and connects to the flywheel 162 through a connecting member, e.g., a belt. In addition, the stationary bike 1 may further include two cranks 19 and two pedals 20. The two cranks 19 are respectively located on the left and right sides of the pulley 161. Each crank 19 includes a first end connected to the axis 163 and a second end connected to a corresponding pedal 20. The top of the seat support 102 connects to a seat 21. The user sits on the seat 21 with his or her feet placed on the pedals 20.

Figure 5:
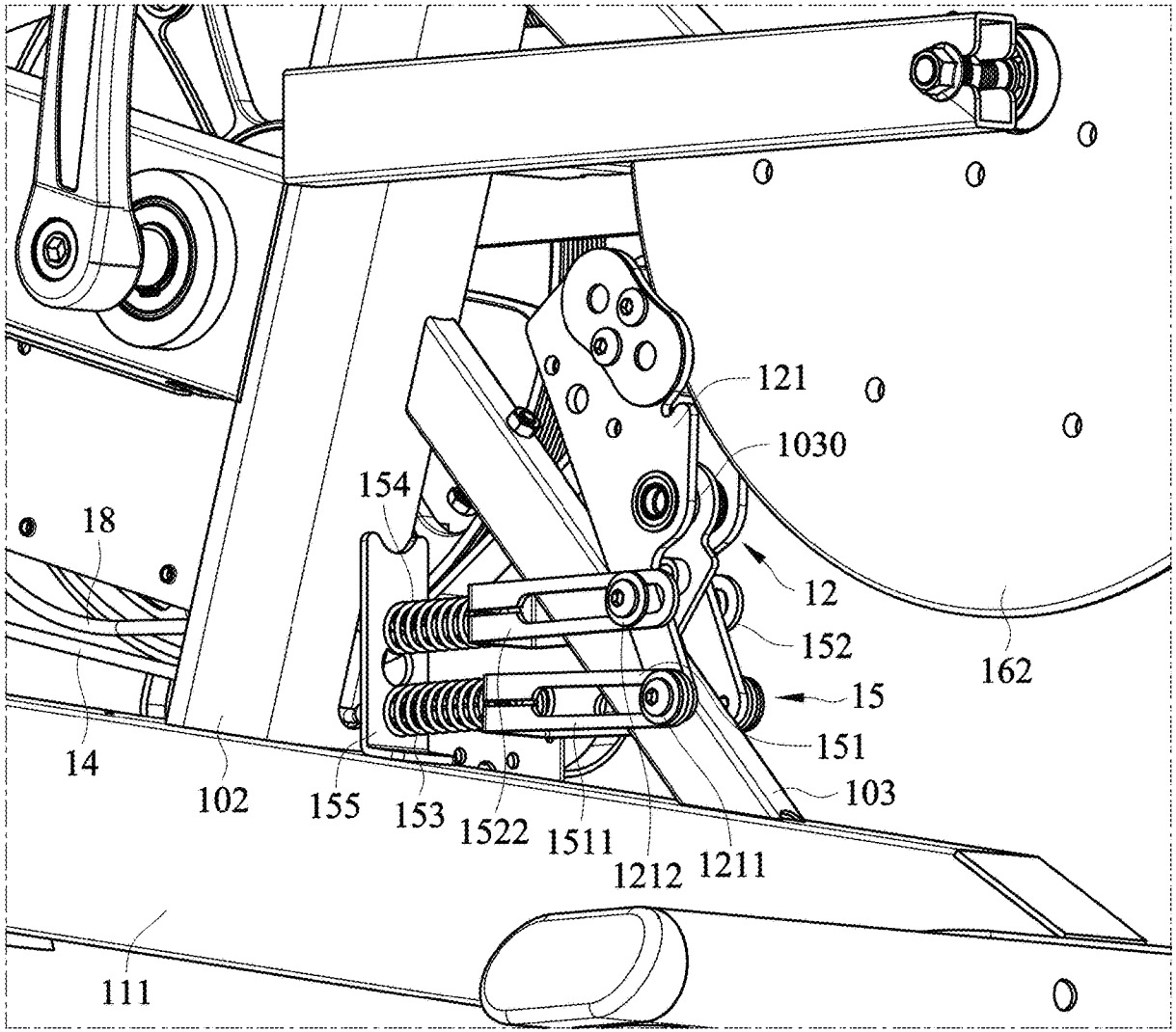
FIG. 5 is a partial enlarged view of the stationary bike shown in FIG. 1.

FIG. 5 is a partial enlarged view of the stationary bike 1 shown in FIG. 1. Referring to FIGS. 1, 2, 3, 4, and 5, the reluctance mechanism 12 may be composed of two side plates 121 arranged in parallel and having the same shape, and the two side plates 121 are pivotally connected to the structure of the frame 10. In the exemplary embodiment, the frame 10 further includes a support arm 103 connected between the seat support 102 and the first lifting arm 111, and the two side plates 121 are pivotally connected to a pivot 1030 protruding from the surface of the support arm 103. In addition, the inner wall of each side plate 121 includes a plurality of magnets (covered by the side plate 121). The polarities of two adjacent magnets on the same side plate 121 are opposite, that is, one is N pole and the other is S pole. The polarities of the two magnets at the same corresponding positions on different side plates 121 are also opposite. When the side plates 121 bring the magnets close to the flywheel 162, resistance is generated. The closer the magnets are to the flywheel, the greater the resistance. In addition, the reluctance mechanism 21 may further include a brake pad (not shown) fixed between the two side plates 121. The brake pad is preferably made of wool felt or rubber.

Referring to FIGS. 1, 2, 3, 4, and 5, the linkage mechanism 15 includes a first linkage seat 151 and a second linkage seat 152 that are generally U-shaped. Each side of the first linkage seat 151 includes a first slot 1511, and the outer surfaces of the two side plates 121 each have a protruding first flange 1211 disposed in the corresponding first slot 1511. Each side of the second linkage seat 152 includes a second slot 1522, and the outer surfaces of the two side plates 121 each have a protruding second flange 1212 disposed in the corresponding second slot 1522. When the first linkage seat 151 drives the two side plates 121 to rotate around the pivot 1030, the two second flanges 1212 move within the corresponding second slots 1522 respectively. Alternatively, when the second linkage seat 151 drives the two side plates 121 to rotate around the pivot 1030, the two first flanges 1211 move within the corresponding first slots 1511 respectively.

Referring to FIGS. 1, 2, 3, 4, and 5, the two ends of the first cable 14 respectively connect to the second lifting arm 112 and the first linkage seat 151, and the two ends of the second cable 18 respectively connect to the emergency brake lever 17 and the second linkage seat 152. The linkage mechanism 15 may further include a first spring 153, a second spring 154, and a spring seat 155. The spring seat 155 is fixed to the first lifting arm 111 or the seat support 102 or connected between the two. The first spring 153 is provided between the spring seat 155 and the first linkage seat 151, and the second spring 154 between the spring seat 155 and the second linkage seat 152. The spring seat 155 includes a first and a second through holes (not shown). The first cable 14 passes through the first through hole of the spring seat 155 and then connects to the first linkage seat 151. The second cable 18 passes through the second through hole of the spring seat 155 and then connects to the second linkage seat 152.

Referring to FIGS. 1, 2, 3, 4, and 5, in the exemplary embodiment, an upper end of the handle support 101 may connect a control panel (not shown) and a handle 22 for a user to hold. The control panel is connected to a control system (not shown). The user can input a desired incline through the control panel, and the control system outputs a control signal accordingly to control the linear mechanism 13, thereby changing the first included angle θ1 and the second included angle θ2, and hence changing an angle between the handle support 101 and ground and an angle between the seat support 102 and the ground. At the same time, when the first included angle θ1 and the second included angle θ2 change, the first cable 14 drags or brings the first linkage seat 151 to cause the two side plates 121 of the reluctance mechanism 12 to pivot and thereby approaching or moving away from the flywheel 162. As a result, the resistance applied to the flywheel 162 is changed simultaneously. FIG. 2 shows that the linear mechanism 13 is controlled at an initial length $L_0$. At this state, the resistance applied to the flywheel 162 is an initial resistance to simulate riding on a flat road.

FIG. 3 shows that the linear mechanism 13 is controlled at the shortest length $L_{min}$ ($L_{min}<L_0$). At this state, the first included angle θ1 and the second included angle θ2 are reduced to the minimum. In the meantime, the first cable 14 brings the first linkage seat 151, causing the two side plates 121 of the reluctance mechanism 12 to pivot and move away from the flywheel 162. At this state, the resistance applied to the flywheel 162 is reduced to minimum to simulate riding on a downhill road.

FIG. 4 shows that the linear mechanism is controlled at the longest length $L_{max}$ ($L_{max}>L_0$). At this state, the first included angle θ1 and the second included angle θ2 increase to the maximum. In the meantime, the first cable 14 drags the first linkage seat 151, causing the two side plates 121 of the reluctance mechanism 12 to pivot and thereby approaches the flywheel 162. At this state, the resistance applied to the flywheel 162 is to increase to maximum to simulate riding on an uphill road.

Referring to FIGS. 3 and 4, the first end 112*a* of the second lifting arm 112 may include a roller 23. When the second included angle θ2 increases, the roller 23 will move toward the rear of the stationary bike 1. When the second included angle θ2 decreases, the roller 23 will move toward the front of the stationary bike 1.

Referring to FIGS. 1, 2, 3, 4, and 5, when the user pulls the emergency brake lever 17, the second cable 18 drags the second linkage seat 152, causing the two side plates 121 of the reluctance mechanism 12 to pivot, and hence causing the brake pad (not shown) to abut the flywheel 162 and thereby to stop the flywheel 162.

Referring to FIGS. 1, 2, 3, 4, and 5, a feature of the stationary bike 1 is that even if the linear mechanism is controlled at the shortest length, the first included angle θ1 and the second included angle θ2 are not zero. That is, only the first end 111*a* of the first lifting arm 111 is in contact with the ground, and only the first end 112*a* of the second lifting arm 112 is in contact with the ground. In other words, the stationary bike of the present invention does not include a "base" in contact with the ground, but the first lifting arm 111 and the second lifting arm 112 replace the traditional "base". In the exemplary embodiment, both the first lifting arm 111 and the second lifting arm 112 are, but are not limited to, T-shaped. This design allows the stationary bike 1 to have a wider adjustable slope range.

Referring to FIGS. 1, 2, 3, 4, and 5, the invented stationary bike has another feature that when the linear mechanism 3 changes its length, the resistance applied to the flywheel 162 also increases or decreases synchronously for a realistic riding experience.

In the embodiment of FIGS. 1-5, the linear mechanism 13 is connected between the handle support 101 and the second lifting arm 112. In another embodiment not shown, the linear mechanism 13 is connected between the seat support 102 and the second lifting arm 112, as shown in FIGS. 4-6 of the TW patent (application No. 113200661) previously applied by the applicant. The content of the foregoing patent is expressly incorporated herein by reference. In addition, in such an embodiment, the two ends of the first cable 14 are connected to the first linkage seat 151 and the first lifting arm 111 respectively.

Although the above embodiment shows a stationary bike with an adjustable incline. It is understood that the principles described in this specification can be applied to any suitable exercise equipment, such as, but not limited to, elliptical trainers, steppers, rowing machines, etc.

From the foregoing, it will be appreciated that specific embodiments of the invention have been described herein for purposes of illustration, but that various modifications may be made without deviating from the scope of the invention. Accordingly, the invention is not limited except as by the appended claims.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended.

What is claimed is:

1. A stationary bike, comprising:

a first lifting arm comprising a first end in contact with a ground and a second end suspended above the ground, wherein the first lifting arm is turnable with its first end as a fulcrum;

a second lifting arm comprising a first end in contact with the ground and a second end suspended above the ground, wherein the second lifting arm is turnable with its first end as a fulcrum, and the second end of the first lifting arm and the second end of the second lifting arm are pivotally connected at a pivot;

a frame being connected to the first lifting arm;

a resistance device disposed on the frame and comprising an axis and a flywheel;

a reluctance mechanism adjacent to the flywheel and pivotally connected to the frame, the reluctance mechanism comprising a plurality of magnets;

a linkage mechanism comprising a first linkage seat that is pivotally connected to the reluctance mechanism;

a first cable having two ends respectively connected to the first linkage seat and the second lifting arm or the first lifting arm; and a linear mechanism being connected between the frame and the second lifting arm, wherein a length of the linear mechanism is adjusted to change an angle between the first lifting arm and the ground and an angle between the second lifting arm and the ground, and at the same time the first cable drives the first linkage seat, causing the reluctance mechanism to pivot and hence to approach or move away from the flywheel thereby changing a resistance applied to the flywheel.

2. The stationary bike according to claim 1, wherein the reluctance mechanism comprises two side plates, the first linkage seat is U-shaped and comprises two sides with each comprising a first slot, and an outer surface of each of the two side plates has a first flange disposed in one corresponding first slot.

3. The stationary bike according to claim 2, wherein the linkage mechanism further comprises a first spring and a spring seat, and wherein the spring seat is fixed to the first lifting arm or the frame or disposed between the two, and the first spring is disposed between the spring seat and the first linkage seat.

4. The stationary bike according to claim 2, further comprising an emergency brake lever and a second cable, wherein the linkage mechanism further comprises a second linkage seat pivotally connected to the reluctance mechanism, and two ends of the second cable are respectively connected to the emergency brake lever and the second linkage seat.

5. The stationary bike according to claim 4, wherein the second linkage seat is U-shaped and comprises two sides with each comprising a second slot, and an outer surface of each of the two side plates has a second flange disposed in one corresponding second slot.

6. The stationary bike according to claim 5, wherein the linkage mechanism further comprises a second spring and a spring seat, and wherein the spring seat is fixed to the first lifting arm or the frame or disposed between the two, and the second spring is disposed between the spring seat and the second linkage seat.

7. The stationary bike according to claim 1, wherein the frame comprises a handle support and a seat support.

8. The stationary bike according to claim 7, wherein the linear mechanism is connected between the handle support and the second lifting arm.

9. The stationary bike according to claim 7, wherein the linear mechanism is connected between the seat support and the first lifting arm.

10. The stationary bike according to claim 1, wherein the linear mechanism comprises a motor, a sleeve, and a screw, and wherein the sleeve comprises an internal thread to engage the screw, and the motor is used to drive the screw to rotate, so that the sleeve is moved along the screw toward or away from the motor, thereby changing the length of the linear mechanism.

11. The stationary bike according to claim 7, wherein when the linear mechanism adjusts its length to change the angle between the first lifting arm and the ground and the angle between the second lifting arm and the ground, both an angle between the handle support and the ground and an angle between the seat support and the ground change accordingly.

* * * * *